US005502474A

United States Patent [19]

Katerberg et al.

[11] Patent Number: 5,502,474

[45] Date of Patent: Mar. 26, 1996

[54] PRINT PULSE PHASE CONTROL

[75] Inventors: James A. Katerberg, Kettering; Randy L. Fagerquist, Dayton, both of Ohio

[73] Assignee: Scitex Digital Printing, Inc., Dayton, Ohio

[21] Appl. No.: 858,796

[22] Filed: Mar. 27, 1992

[51] Int. Cl.[6] ..... B41J 2/02

[52] U.S. Cl. ..... 347/75; 347/78

[58] Field of Search ..... 346/75; 347/75, 347/78

[56] References Cited

U.S. PATENT DOCUMENTS 4,631,949 12/1986 Braun et al. ..... 346/75 X

*Primary Examiner*—Peter S. Wong

*Assistant Examiner*—Randy W. Gibson

*Attorney, Agent, or Firm*—Barbara Joan Haushalter

[57] ABSTRACT

A print pulse phase control system for a continuous ink jet printer determines whether to charge ink droplets for recirculating, or not to charge ink drops for printing. The system includes a drop generator which receives a drive signal and generates a feedback signal. Print pulses are then produced at a fixed phase relative to the feedback signal for controlling drop charging.

20 Claims, 2 Drawing Sheets

PRINT PULSE PHASE CONTROL

TECHNICAL FIELD

The present invention relates to continuous ink jet printers and, more particularly, to an improved print pulse phase control.

BACKGROUND ART

Ink jet printing systems are known in which a print head defines one or more rows of orifices which receive an electrically conductive recording fluid from a pressurized fluid supply manifold and eject the fluid in rows of parallel streams. Printers using such print heads accomplish graphic reproduction by selectively charging and deflecting the drops in each of the streams and depositing at least some of the drops on a print receiving medium, while others of the drops strike a drop catcher device.

In ink jet printers of the continuous type, drops are selectively charged or left uncharged in response to the voltage on the charging electrodes at the time of drop break off. The formation of an uncharged print drop requires that the drop break off within the time interval of the zero voltage print pulse. A print error is produced if the drop fails to break off during the falling or rising edge transitions of the print pulse. To guard against this occurrence, it is necessary to adjust the phase of the print pulse relative to drop break off. As the drop break off phase with respect to the drive signal is very difficult to continuously monitor in a printer, the print pulse phase is set relative to the stimulation drive signal.

In known continuous ink jet printers, periodic rephasing procedures involving measurements of either drop charge or drop deflection are used. These procedures generally involve determining the desired print pulse phase with respect to the drive signal by monitoring the drop charge or deflection as the print pulse phase is stepped through the allowed range relative to the stimulation drive signal and detecting the desired result. The print pulse phase is then fixed relative to the stimulation drive signal. As the drop break off phase can drift relative to the stimulation drive signal, the printer must be periodically rephased. Depending on the printer, this rephasing period varies from one per document to one per hour, with a minimum of one each time the printer is started. Due to the small charge and the deflection of the drops, the phase test measurements have fairly low signal-to-noise levels, and can be plagued by ink mist build up, contaminating the detector. These periodic rephasing tests therefore add to the cost of the printer and can cause reliability problems.

Additional problems can be encountered with traveling wave stimulation, as disclosed in U.S. Pat. Nos. 4,999,644, and 4,972,201, due to the phase delay produced by the propagation time and attenuation of the flexure wave down the orifice plate. Furthermore, the phase of flexure wave can drift in response to temperature induced changes in the damping materials employed at the ends of the orifice plate. In piston type drop generators, such as is disclosed in U.S. Pat. No. 4,554,558, the resonating piston or crystal produces a pressure modulation at the back of the fluid cavity. This modulation produces a standing or resonating pressure wave in the fluid cavity. The phase of the pressure modulation at the orifices can vary relative to the modulation phase at the back of the cavity in response to temperature or concentration induced changes in ink sound velocity.

It is seen then that there is a need for an improved print pulse phase control which does not require either drop charging or drop deflection measuring means to determine the operating phase, or the need for periodic rephasing operations.

SUMMARY OF THE INVENTION

This need is met by the system according to the present invention, wherein the print pulse phase is fixed relative to the drop break off phase, eliminating the requirement of periodic rephasing tests.

In accordance with one aspect of the present invention, a print pulse phase control system for a continuous ink jet printer comprises a drop generator capable of receiving a drive signal and generating a feedback signal in response thereto, and a means for producing print pulses at a fixed phase relative to the feedback signal.

Accordingly, it is an object of the present invention to provide an improved means for maintaining the print pulse phase relative to the drop break off phase. The present invention is advantageous in that it eliminates the need for periodic rephasing operations and the phase measurement electronics generally required. It is a further advantage that automated rephasing operations employing electronic break off phase measuring systems are generally unnecessary, due to the greatly reduced need for rephasing operations.

Other objects and advantages of the invention will be apparent from the following description, the accompanying drawings and the appended claims.

DETAILED DESCRIPTION OF THE PREFERRED EMBODIMENTS

Figure 1:
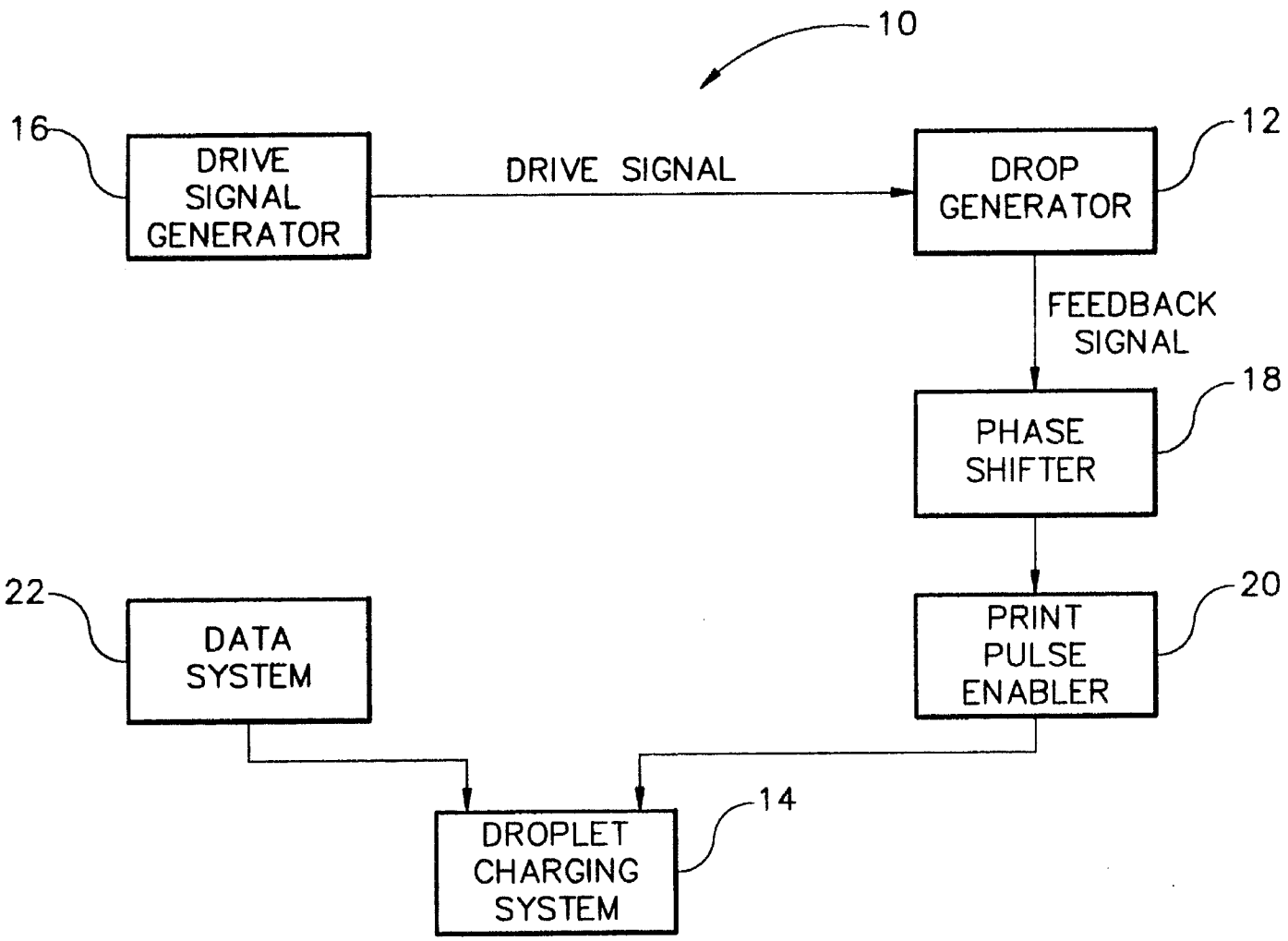
FIG. 1 is a block diagram of an embodiment of a print pulse phase control system.

The present invention provides a system and a method for maintaining the print pulse phase relative to the drop break off phase. The system and method of the present invention do not require drop charging or drop deflection measuring means to determine the operating phase. Since the present invention provides for fixing the print pulse relative to the feedback signal, the use of the drive signal phase as the operational phase reference would not require periodic rephasing tests.

To ensure proper control of drops, the print voltage pulses must be properly timed relative to the drop break off. Since the drop break off phase drifts relative to the drive signal, the present invention does not rely on the stimulation drive signal as the phase reference for the print pulse. Instead, the present invention utilizes a feedback signal from the drop generator which closely tracks the drop break off phase as the phase reference for the print pulse. In order to understand how a feedback signal from the drop generator can be a more desirable phase reference than the stimulation drive signal, it is helpful to note the origin of the phase shift between the stimulation drive signal and drop break off. This phase shift has two components, including a first phase delay due to the jet dynamics, and a second phase delay due to the characteristics of the drop generator itself.

The first phase delay is the result of the propagation time of the jet disturbance down the jet from the orifice to the break off point. This disturbance travels down the jet at approximately the jet velocity. The propagation delay is, therefore, the break off length, which is the distance from the orifice to the position where the jet breaks to produce a drop, divided by the jet velocity. As the drive amplitude changes, the break off length changes. Also, as the ink pressure or temperature changes, the break off length and the jet velocity change, which causes drifts in the propagation phase. For example, with a typical ink, a small change, such as 10%, in stimulation amplitude around the operating point produced only a 45° phase shift. Similarly, small temperature and pressure changes, such as 25° F. and 2 psi, respectively, also resulted in only a 45° phase shift. The propagation delay down the jet is, therefore, not a significant cause of phase shift between the drive signal and the drop break off. In general, then, the propagation phase is fairly constant for small changes in ink temperature, ink pressure, or stimulation amplitude.

The second phase shift is produced in the resonating drop generator and is the phase between the drive signal and the vibration of the orifice plate. As a result of the resonant nature of the drop generator, this phase can vary rapidly as a function of the driving frequency. This results in a rapid change in vibration phase of the drop generator for changes in drive frequency near resonance. Since the resonant frequency of the drop generators is temperature dependent, the vibration phase will drift as a result of small temperature changes. For drop generators with a very high Q factor, a small temperature change such as 10 degrees Fahrenheit can result in a 180 degree phase shift of the vibration phase and, therefore, of the jet disturbance.

To avoid these phase shifts produced by the structure of the drop generator, the present invention uses a feedback probe which is attached to the drop generator. The probe is located such that the phase of the vibration at the probe is well defined relative to the vibration phase at the orifices. For resonant body type drop generators, a piezoelectric crystal attached to the side of the drop generator is effective. For a travelling wave type drop generator, a piezoelectric crystal which detects the flexure wave of the orifice plate is preferred. Piston type drop generators would be monitored effectively by a small hydrophone which detects the stimulating pressure fluctuations in the fluid cavity. Such a probe can therefore effectively monitor the stimulation phase for the jets without being affected by the phase shifts intrinsic to driving a drop generator. As the propagation delay phase shift is fairly constant near the operating condition, there is little drift in the phase between the feedback signal and the drop break off. The use of the feedback signal as the phase reference for the print pulse therefore eliminates the need for periodic rephasing operations.

Referring now to the drawings, in FIG. 1 a print pulse phase control system 10 includes a drop generator 12 for producing streams of ink which break into droplets. A droplet charging system 14 may charge one or more of the ink droplets from the drop generator 12. The drop generator 12 is driven by an electrical drive signal from a drive signal generator 16. An output signal, or feedback signal, generated by the drop generator 12 is used as an input signal to a phase shifter 18. The phase shifter 18 generates an output signal which is phase shifted a controlled amount with respect to the input feedback signal. This phase shift provides the compensation for the relatively fixed phase shift between the feedback signal and the drop break off, to ensure that the print pulse is approximately centered around the average drop break off time.

The phase shifter 18 could be set during print head assembly. Alternatively, it may be desirable to have it adjustable by the operator to compensate for different ink types. While an electronic test may be employed to set the phase, it can also be simply adjusted by the operator while examining print samples. Setting of the print pulse phase for acceptable printing can be performed by printing a series of representative sample images while selecting a range of phase shift values from the phase shifter 18. The optimum value of the phase shift is that which gives the best print quality and widest printing latitude. The phase shift is left unchanged until a system change occurs requiring reselection.

Continuing with FIG. 1, the output of the phase shifter 18 is used as an input into a print pulse enabler 20. A data system 22, then, supplies drop selection data to the droplet charging system 14, while the timing of the print pulses from the droplet charging system 14 is controlled by the signal from the print pulse enabler 20. FIG. 1, then, illustrates the primary invention involving use of the feedback signal. In FIG. 1, the feedback signal is provided from the drop generator 12 to the print pulse enabler 20 via the phase shifter 18.

Figure 2:
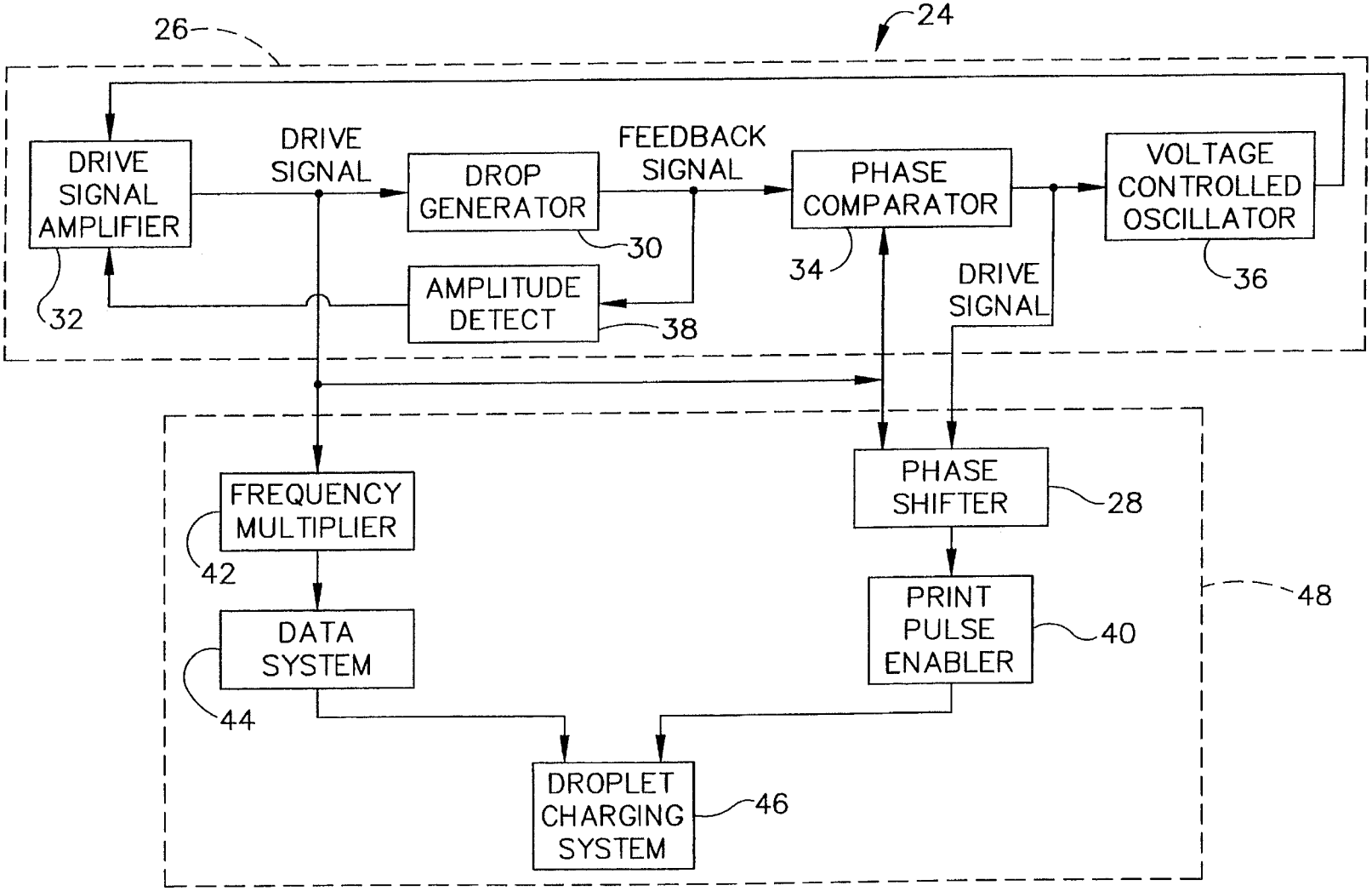
FIG. 2 is a block diagram illustrating a preferred embodiment of the print pulse phase control system shown in FIG. 1.

Obviously, many modifications and variations are possible without departing from the scope of the invention illustrated in FIG. 1. For example, an alternative embodiment of a print pulse phase control system 24 shown in FIG. 2 may be preferable for some applications. In particular, for resonant body type drop generators, the phase shift between the drive signal and the feedback signal is purely a function of the operating frequency relative to the resonant frequency. By employing an electronic means such as a phase locked loop 26 to generate the driving frequency, the embodiment in FIG. 2 tracks resonance, providing for improved drive efficiency. In FIG. 2, the drive signal is fixed relative to the feedback signal, so either the drive signal or the feedback signal can be provided as an input to a phase shifter 28. As a practical matter, the drive signal is stronger than the feedback signal, so it may be desirable to use the drive signal.

Referring now to FIG. 2, the print pulse phase control 24 includes a drop generator 30 capable of receiving a drive signal from a drive signal amplifier 32, and generating a feedback signal to a phase comparator 34. The drive signal from the drive signal amplifier 32 is used as a second input signal to the phase comparator 34. The phase comparator 34, then, produces an output signal which is determined by the phase difference between the feedback signal input and the drive signal input. An output from the phase comparator 34 is used as an input signal to a voltage controlled oscillator 36, causing the voltage controlled oscillator 36 to produce a phase locked frequency output signal.

As illustrated in the block diagram of FIG. 2, the phase locked frequency output signal generated by the voltage controlled oscillator 36 is input to the drive signal amplifier 32 which amplifies the drive signal to the level required for proper operation of the drop generator 30. An amplitude detect circuit 38 monitors the feedback signal from the drop generator 30 and provides an input to the voltage controlled drive signal amplifier 32. In this way, the stimulation amplitude can be servo controlled. The feedback signal from the drop generator 30, therefore, can be used in the control of the stimulation amplitude as well as for control of phasing. Hence, the drop generator 30, the drive signal amplifier 32, the phase comparator 34, the voltage controlled oscillator 36, and the amplitude detect circuit 38, comprise the electronic means 26 for maintaining a constant drive-to-feedback phase difference under a variety of operating conditions. The servo loop 26 is used to ensure a fixed feedback amplitude to maintain the proper stimulation amplitude. Since the drive signal is fixed relative to the feedback signal, either the drive or the feedback signal can be provided to a print pulse enabler 40, via the phase shifter 28.

Continuing with FIG. 2, the drive signal from the drive signal amplifier 32 is also supplied to a frequency multiplier 42. The frequency multiplier 42 produces an output signal having a frequency which is a multiple of the drive signal amplifier 32 output frequency. The frequency multiplier 42 output signal is used as an input clocking signal for a data system 44. In this way, the data system 44 is synchronized with the drop generator 30, ensuring that data is supplied to a droplet charging system 46 at a rate that matches the drop production rate. The data system 44 provides the drop selection data to the droplet charging system 46.

The phase shifter 28, the print pulse enabler 40, the frequency multiplier 42, the data system 44, and the droplet charging system 46 comprise a drop selection means 48. The phase shifter 28 provides an input signal to the print pulse enabler 40. The output from the phase shifter 28 has an adjustable phase difference with respect to the drive signal input. The droplet charging system 46 produces the necessary print pulses as determined by print select data received from the data system 44 with the timing of the print pulses controlled by the signal from the print pulse enabler 40.

The droplet charging system 46 produces an output signal, based on the first and second inputs from the data system 44 and the print pulse enabler 40, respectively. The droplet charging system 46 output is used by an ink jet print head associated with the drop generator 30 of a continuous ink jet printer to determine whether or not a particular droplet from the drop generator 30 is to be printed, i.e., uncharged, or recycled, i.e., charged.

In the present invention, the vibration phase is obtained from the signal of a feedback transducer which is on the drop generator 12 or 30. This is the same transducer which may be used for monitoring the amplitude of vibration. The print pulse phase setting for acceptable printing can be performed by printing a series of representative sample images while selecting a range of phase shift values from the phase shifter 18 or 28. Obviously, the optimum value of the phase shift is that which gives the best print quality and widest printing latitude.

Industrial Applicability and Advantages.

The present invention is useful in the field of ink jet printing, and has the advantage of providing print pulse phase control for a continuous ink jet printer. The system of the present invention is advantageous in that there are no lengthy, untimely, scheduled printer operation interruptions due to rephasing requirements. Due to the greatly reduced need for rephasing operations, automated rephasing operations employing electronic break off phase measuring systems, such as droplet charge or deflection tests, are generally unnecessary. Additionally, there is no microprocessor activity or software development, implementation, or execution necessary for the print pulse phase setting.

Having described the invention in detail and by reference to the preferred embodiment thereof, it will be apparent that other modifications and variations are possible without departing from the scope of the invention defined in the appended claims.

What is claimed is:

1. A print pulse phase control system of a continuous ink jet printer comprising:

a drop generator capable of receiving a drive signal and having a means for generating a feedback signal;

a means for comparing a phase of the feedback signal relative to the drive signal and producing a comparator signal in response thereto;

output means for using the comparator signal to output a control signal for controlling a frequency of the drive signal; and means for producing print pulses at a fixed phase relative to the feedback signal.

2. A print pulse phase control system as claimed in claim 1 wherein the fixed phase between the print pulses and the feedback signal is adjustable.

3. A print pulse phase control system as claimed in claim 1 wherein the drive signal originates from an external frequency source.

4. A print pulse phase control system as claimed in claim 1 wherein the drive signal is capable of tracking a resonance of the drop generator.

5. A print pulse phase control system as claimed in claim 4 wherein the resonance of the drop generator is tracked using a phase lock loop.

6. A print pulse phase control system as claimed in claim 1 further comprising:

a phase shifter means for producing a phase shifted drive signal; and means for providing the phase shifted drive signal to a print pulse enabler.

7. A print pulse phase control system as claimed in claim 1 further comprising a drop selection means which is operable at a frequency that is a fixed multiple of the drive signal.

8. A print pulse phase control system as claimed in claim 1 wherein the means for generating a feedback signal comprises a means for measuring stress on the drop generator.

9. A print pulse phase control system as claimed in claim 1 wherein the means for generating a feedback signal comprises a means for detecting a flexure wave in the drop generator.

10. A print pulse phase control system as claimed in claim 1 wherein the means for generating a feedback signal comprises a means for detecting ink pressure fluctuations within the drop generator.

11. A method for controlling print pulse phase for a continuous ink jet printer comprising the steps of:

providing a drop generator capable of receiving a drive signal and generating a feedback signal;

comparing a phase of the feedback signal relative to the drive signal and producing a comparator signal in response thereto;

using the comparator signal to output a control signal for controlling a frequency of the drive signal; and producing print pulses at a fixed phase relative to the feedback signal.

12. A method for controlling print pulse phase as claimed in claim 11 wherein the fixed phase between the print pulses and the feedback signal is adjustable.

13. A method for controlling print pulse phase as claimed in claim 11 wherein the drive signal originates from an external frequency source.

14. A method for controlling print pulse phase as claimed in claim 11 wherein the drive signal is capable of tracking a resonance of the drop generator.

15. A method for controlling print pulse phase as claimed in claim 14 wherein the resonance of the drop generator is tracked using a phase lock loop.

16. A method for controlling print pulse phase as claimed in claim 11 further comprising the steps of:

producing a phase shifted drive signal; and providing the phase shifted drive signal to a print pulse enabler.

17. A method for controlling print pulse phase as claimed in claim 11 further comprising the step of using a drop selection means which is operable at a frequency that is a fixed multiple of the drive signal.

18. A method for controlling print pulse phase as claimed in claim 11 wherein the step of generating a feedback signal comprises the step of measuring stress on the drop generator.

19. A method for controlling print pulse phase as claimed in claim 11 wherein the step of generating a feedback signal comprises the step of detecting a flexure wave in the drop generator.

20. A method for controlling print pulse phase as claimed in claim 11 wherein the step of generating a feedback signal comprises the step of detecting ink pressure fluctuations within the drop generator.

* * * * *